United States Patent [19]

Falco

[11] Patent Number: 4,913,553

[45] Date of Patent: Apr. 3, 1990

[54] METHOD AND APPARATUS FOR DELIVERING MULTI-COMPONENT ADHESIVE SYSTEMS

[76] Inventor: Gene A. Falco, 88 Toledo St., Farmingdale, N.Y. 11735

[21] Appl. No.: 242,952

[22] Filed: Sep. 9, 1988

Related U.S. Application Data

[63] Continuation of Ser. No. 129,583, Dec. 7, 1989, abandoned.

[51] Int. Cl.[4] ..... B01F 15/02

[52] U.S. Cl. ..... 366/129; 222/137; 366/177; 366/184

[58] Field of Search ..... 366/150, 177, 349, 348, 366/338, 129, 196, 184, 332, 189, 190; 222/135, 137

[56] References Cited

U.S. PATENT DOCUMENTS

| | | | |
|---|---|---|---|
| 3,952,920 | 4/1976 | Bergman | 222/137 |
| 4,046,288 | 9/1977 | Bergman | 222/135 |
| 4,538,920 | 9/1985 | Drake | 366/177 |
| 4,668,097 | 5/1987 | Nygren | 366/177 |
| 4,676,657 | 6/1987 | Botrie | 366/177 |

*Primary Examiner*—Robert W. Jenkins
*Attorney, Agent, or Firm*—Bauer & Schaffer

[57] ABSTRACT

A multicomponent adhesive system is provided wherein the components are stored in containers, each having an orifice at one end and a slideable plunger at the other. The containers holding identical components are arranged diagonally to each other on opposite sides of a common axis. A force is applied simultaneously against each of the slideable plungers to push the components from each container through each orifice. The components are mixed directly as they are pushed from the container to be extruded to said work site.

17 Claims, 4 Drawing Sheets

Fig. 1
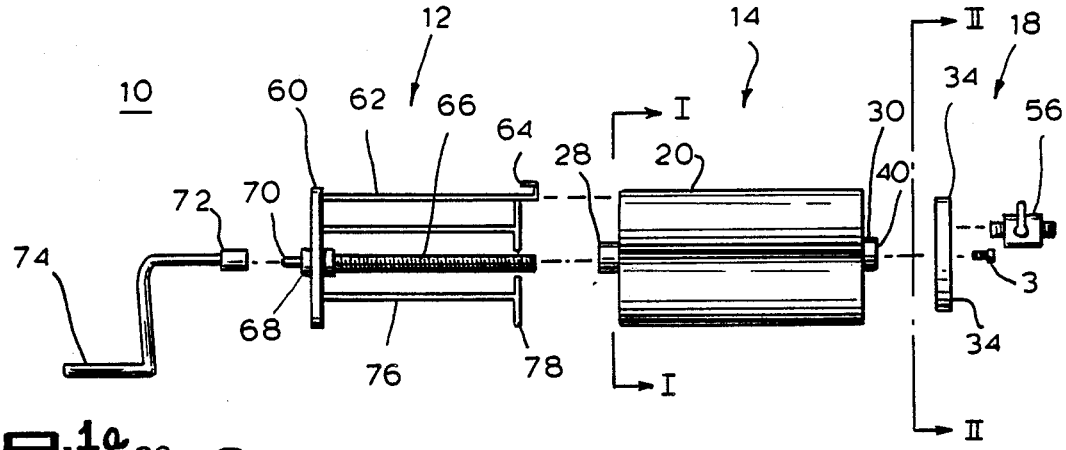
Fig. 1a
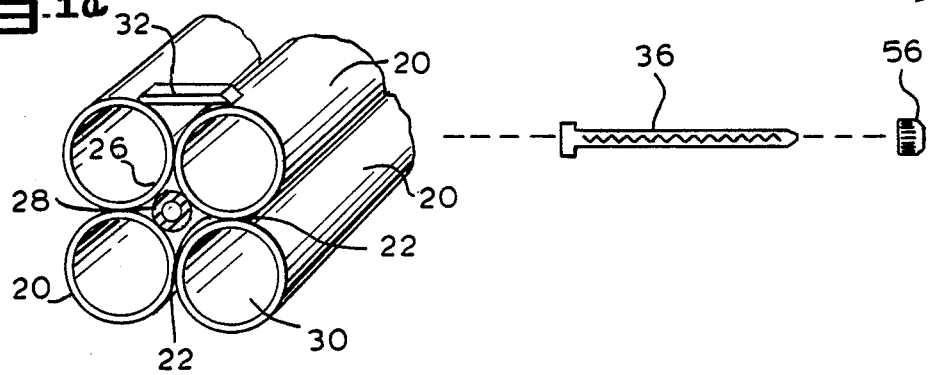
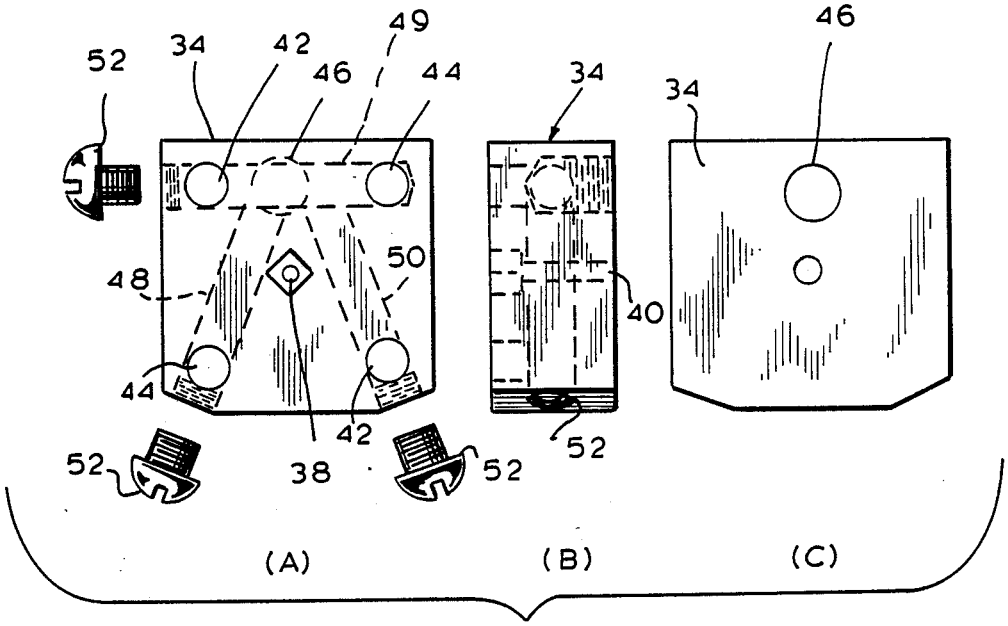
Fig. 2

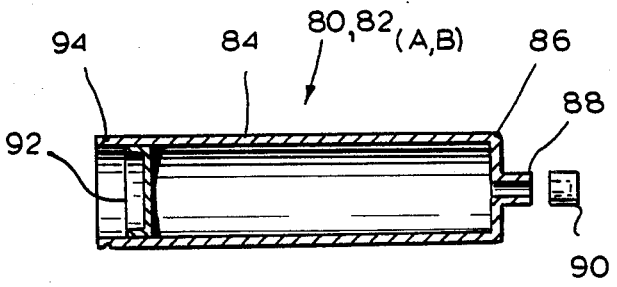
Fig. 3
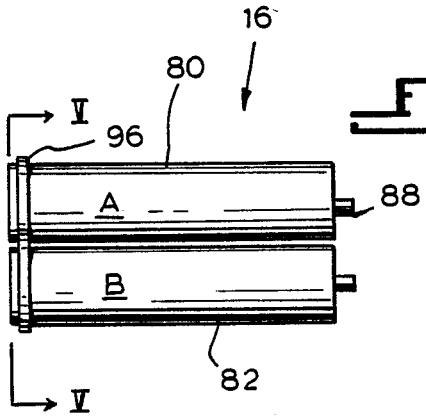
Fig. 4
Fig 5
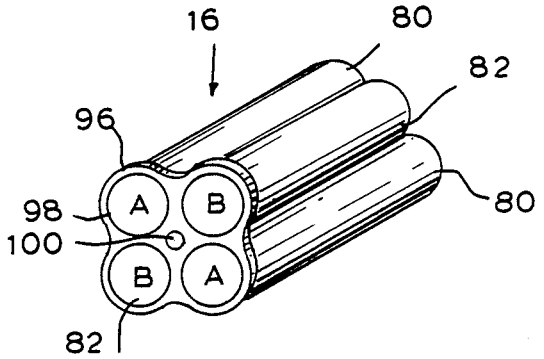
Fig. 6
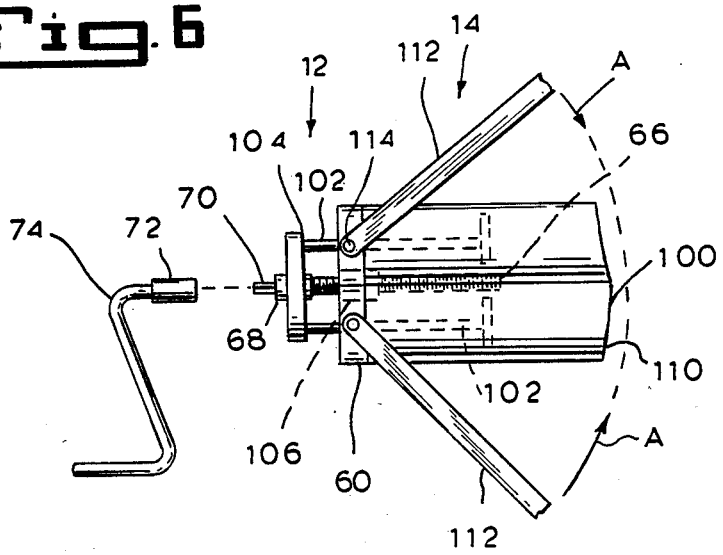

Fig. 7
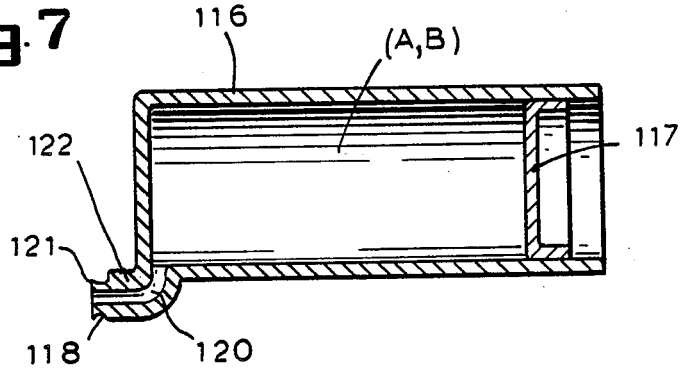
Fig. 8
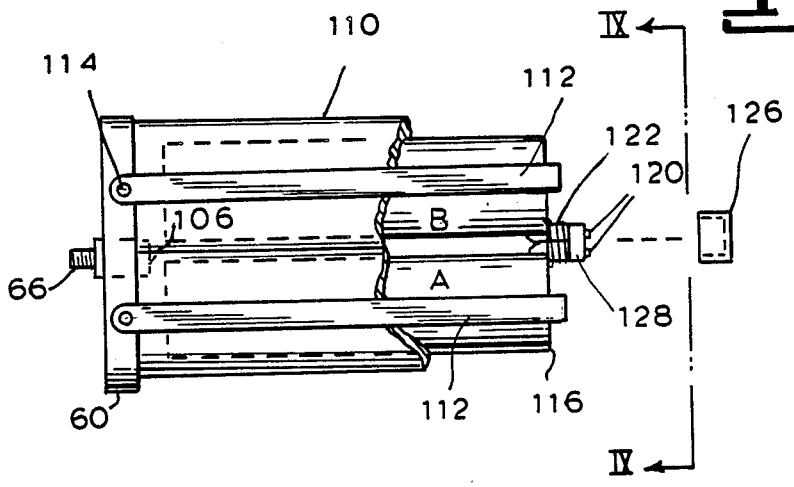
Fig. 9
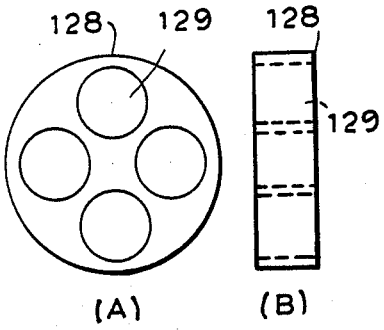
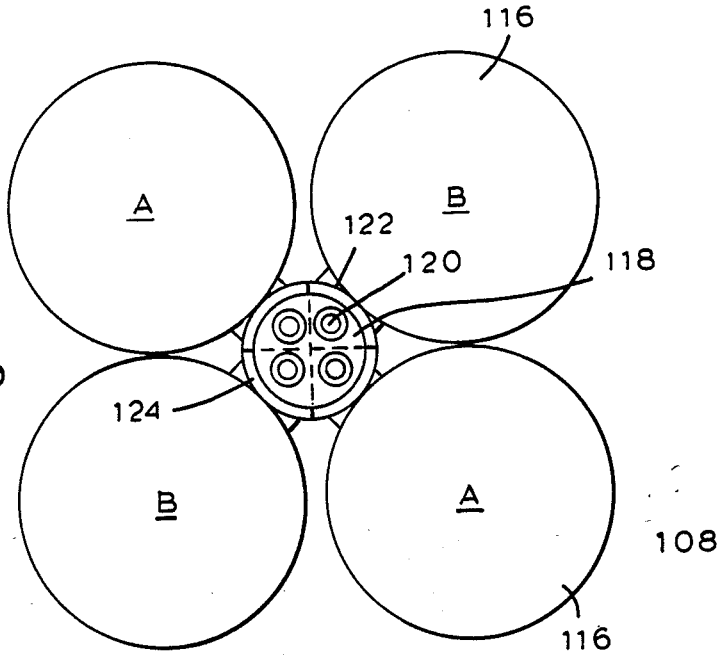
Fig. 10

METHOD AND APPARATUS FOR DELIVERING MULTI-COMPONENT ADHESIVE SYSTEMS

RELATED APPLICATION

This is a Continuation of my co-pending application Ser. No. 129,583 filed Dec. 7, 1987, now abandoned, for which all claims to priority is made.

BACKGROUND OF THE INVENTION

The present invention relates to a method and apparatus for delivery of multi-component adhesive systems to a work site and in particular, to a cartridge type tool for simultaneously mixing and extruding the mixed adhesive components to such places as voids, holes and apertures in building and masonry structures.

Two part epoxy adhesive systems are widely used. In such systems, the resin must be kept separate from the hardener, until virtually the last moment before application, since otherwise, the system would prematurely set and cure. Such separation is insured during transport by storing each component in its own container, generally a relatively rigid cylindrical cartridge having a moveable rear wall. There are many instances however, where the work site onto which or into which the adhesive must be placed, is highly inaccessible or difficult to reach. Thus, the mixing of the two components, close to the work site, is most difficult and sometimes impossible. Many of these sites, particularly in the construction of building and masonry structures, also require the adhesive system to be applied under pressure to insure complete filling of the holes or voids.

Reference can be made to my earlier applications Ser. No. 047,167 filed May 7, 1987 and Ser. No. 135,662 filed Dec. 21, 1987 which describe a process for securing and anchoring together building elements, such as masonry stone facia and the like wherein self-curable hardenable adhesives are applied into hollow chambers, holes or the like, either alone or in combination with mesh sleeves and anchoring rods which eventually become permanently imbedded into the adhesive. The processes described in the foregoing applications are explanatory of the uses for plural component adhesive systems wherein mixing and extrusion of the adhesive is most effective at the work site. Of course, it will be understood that such exemplification is not exclusive of other systems or applications for which a similar need exists. Therefore, there is a serious requirement for highly portable mixing and extrusion system, to which the present invention is addressed.

One known portable epoxy injection apparatus makes use of a two cartridge system wherein the cartridges, one containing the first component and the other containing the second component are placed in a dispenser which uses two parallel pistons driven by a single drive shaft to deliver both components to a static mixing nozzle. A potential problem exists in that two components generally have widely varying viscosities creating a load imbalance between the two pistons. This may cause dispenser to malfunction and/or cartridge to rupture or result in improper mix ratio entering the static mixing nozzle.

Another known injection system makes use of a single coaxial body where the cartridge containing the first component is arranged within the cartridge containing the second component thus defining a cylinder within the cylinder arrangement. This arrangement is used in conjunction with a dispenser which utilizes a single drive shaft with two coaxial plungers attached which force the two components from the coaxial cartridge into a static mixing nozzle. A problem exists with this arrangement for materials of widely different thicknesses or viscosities causing a pressure imbalance wherein the wall of the inner chamber of the cartridge will collapse or inflate to the point of rupture. In a less severe situation, the material may flow from the cartridge at an improper mix ratio as it enters the nozzle.

Generally, all the existing portable epoxy injection equipment lack the ability to balance the two disparate fluids of the resin and hardener. In existing equipment, differences between fluid component thickness cause imbalance in the dispenser and the cartridge cavities resulting in either a cartridge rupture and/or dispenser malfunction. Each condition results in mix ratio variations entering the static mixing nozzle. This can and does cause performance failure when it goes unnoticed.

The foregoing problems are somewhat exacerbated by the fact that the conventional component cartridges are made of thin walled plastic, paper, or plastic impregnated paper, where materials are elastic under internal pressure and relatively easy to rupture or collapse.

It is the object of the present invention to provide an improved portable extrusion system for at least two component adhesive systems.

It is a further object of the present invention to provide simple, economic and easily manipulatable apparatuses delivering two or more component adhesives.

It is a particular object of the present invention to provide a tool for the extrusion of a multi-part adhesive system employing cartridges arranged for balanced extrusion.

It is yet another object of the present invention to provide a tool for the extrusion of multi-part adhesive systems in which rupture or collapse of the component cartridges are prevented.

The foregoing objects and advantages, as well as others, will be apparent from the following disclosure and from the embodiments of the invention as illustrated in the accompanying drawings.

BRIEF DESCRIPTION OF THE DRAWINGS

In the Drawings:

FIG. 1 is an exploded schematic view of an epoxy dispensing tool embodying the present invention, illustrating both method and apparatus;

FIG. 1*a* is a sectional view through line I—I of FIG. 1;

FIG. 2*a* is a view of the mixing manifold taken in the direction of line II—II of FIG. 1;

FIG. 2*b* is a side view of the manifold shown in FIG. 2*a;*

FIG. 2*c* is a front elevational view of the manifold shown in FIG. 2*a;*

FIG. 3 is a sectional view of a component cartridge used in the tool of FIG. 1;

FIG. 4 is a side view of a cluster of cartridges showing two of the four cartridges used in the tool of FIG. 1;

FIG. 5 is a view of the cartridge assembly of FIG. 4 taken along line IV—IV;

FIG. 6 is a exploded view of another embodiment of a tool employing the present invention;

FIG. 7 is a sectional view of a cartridge employed in the cluster to be used in the tool of FIG. 6;

FIG. 8 is a side view of a cluster of cartridges, showing two of the four cartridges used in the apparatus of FIG. 7;

FIG. 9 is a view of the cartridge cluster of FIG. 8 taken in the direction of line IX—IX;

FIG. 10*a* is a plan view of a wafer-like fitting employed to secure the nozzles of the individual cartridges in the cluster shown in FIG. 9;

FIG. 10*b* is a side view of the fitting shown in FIG. 10*a*;

DESCRIPTION OF THE INVENTION

Figure 11:
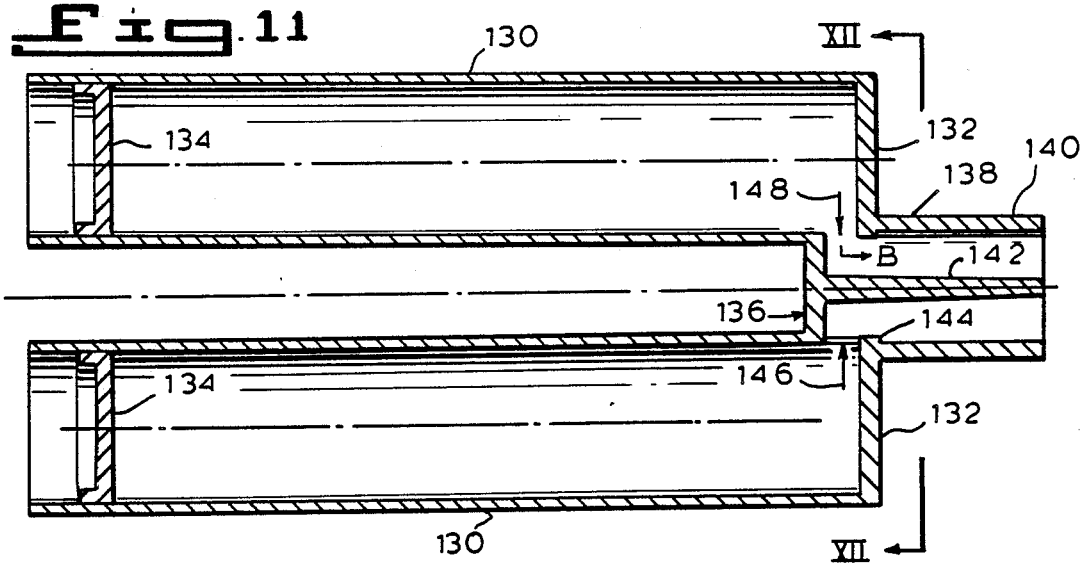
FIG. 11 is a sectioned view of a third embodiment illustrating a four cavity molded cartridge cluster and exit nozzle used in the tool of FIG. 6.

The method of the present invention, as well as one embodiment of the apparatus, is generally illustrated in apparatus identified in FIG. 1, as a tool 10 comprising an extrusion drive assembly 12, a barrel assembly 14 for holding a cluster of adhesive component cartridges 16, (FIGS. 3–5) and a dispensing nozzle assembly 18 in which the adhesive components are mixed and from which the mixed system is extruded.

The core portion of the tool 10 comprises the barrel assembly 14, which, as seen in FIG. 1*a* consists of four rigid cylinders 20 arranged parallel to each other and closely packed symmetrically about a central axis so as to be in contact with each other. The cylinders 20 are simple, formed of cylindrical tubular stock open at each end and welded together along their lines of contact 22, to provide a four barrel fixed and rigid construction leaving an enlarged central opening 26 into which a sleeve 28 is itself welded to the cylinders in fixed position. The sleeve 28 is internally threaded at at least its rear end and partially along its length and is plugged at its forward end 30 which extends slightly beyond the front ends of the cylinders. The cylinders and the sleeves are preferably formed of aluminum or other metal although rigid, strong plastic may be used, if desired. The barrel assembly 14 may be formed of partial tubular members arranged to form the parallel cylinders, or a single piece of sheet metal bent to form the cylinders. The tubular stock may also be polygonal in cross section provided they can receive and hold the cartridges.

The rear end of each of the cylinders 20 are open to receive the cartridges of each cluster 16 (FIGS. 4,5) and a bracket 32 is welded to the exterior surface between two of the cylinders 20 to provide one part of an articulated connection to the drive assembly 12 which, as will become more apparent hereinafter, will form a rear loading separable breech for the introduction of the cartridge cluster 16 into the barrel assembly. The forward end of the barrel assembly 14 is closed by a manifold plate 34 which is part of the nozzle assembly 18 through which the adhesive components are extruded via an elongated and internally baffled tube 36. The manifold plate 34 is secured to the barrel assembly 14 by a screw 38 entering into a conformingly threaded hole 40 in the plug 30 at the forward end of the sleeve 28.

As seen in FIG. 2, the manifold plate 34 is provided with two pair of blind holes 42 and 44 on their rear face. Holes 42 and 44 are designed to respectively receive the outer nipples of the cartridges, shown in FIGS. 3 and 4 in such a way as to form a liquid seal. Resins entering manifold 34 via holes 42 and 44 join via pathways 48, 49 and 50 of FIG. 2. The bores 48, 49 and 50 are closed at the ends, through which they were drilled, by a screw cap 52 which may be removed after use to clean the manifold. Screwed into the common nozzle orifice 46, is a shut-off valve fitting 54, which is manually operable between an open position and a closed position. Finally, the nozzle assembly is completed by the elongated tubular extrusion tube 36 screwed on to the fitting 54. The tube 36 cooperates with the valve fitting 54 and the orifice 46 of the manifold to form a tortuous chamber in which complete mixing of the resin and hardener components take place, so that a uniformly homogeneous mixture of the adhesive system is extruded. The mixing nozzle 36 is shaped to enter into masonry holes, voids, anchor sleeves, etc., and may be curved, shortened and lengthened as the need dictates. Mixer retaining cap 56 slides over mixing nozzle 36 and threads onto valve 54 forming the necessary liquid seal.

The crank assembly 12, as seen in FIG. 1 comprises a supporting body 60 from which extends an elongated guide 62, having a hook 64 at its forward end adapted to engage with the bracket 32 mounted on the rear end of barrel assembly 14. Engagement of the hook 64 and bracket 32 permits the barrel assembly to be moved axially from a rearward position when the rear end of the barrels 20 abut the body 60, to a forward position limited by the hook 64 itself. In the forward position, the barrel assembly 14 is thus separated from the crank assembly 12, although held to it by the hook and may be swung upwardly, to open a breech between the crank assembly 12 and the barrel assembly 14.

Extending from the center of the body 60 is a rotatable threaded drive rod 66 adapted to thread into the sleeve 28 of the barrel assembly 14. The drive rod 66 is rotatably held, but axially fixed in the body 60, by a coupling 68 and is provided on its outer end with a hex or other polygonal stub rod 70 onto which a correspondingly formed socket 72 of a crank handle 74 fits. Four piston rods 76, extending parallel to the drive screw rod 66, are fixed at their rear end to the body 60 and are provided at their front ends with a piston head 78. The piston rods 76 are arrayed about the drive rod 66 so that they fit into respective one of the cartridges of the cluster assembly 16, FIG. 4, when inserted into the barrels 20.

The cartridge cluster 16, as shown in detail in FIGS. 3, 4 and 5, comprise two pairs of cartridges 80 and 82 arranged alternately to each other about a central axis. One cartridge 80 in each pair contains a first component A (e.g. resin) while the other cartridge 82 contains the second component B (e.g. hardener). Thus, the first and second components A and B are arranged alternately and diagonally with respect to the central axis.

As seen in FIGS. 3 and 4, each of the four cartridges 80, 82 comprise a cylindrical shell 84 FIG. 3, closed at its forward end 86 except for a nipple outlet opening 88, which is normally covered by a sealing cap 90 during storage and transport. The cartridges 80 and 82 are made from a moldable plastic, such as polyethylene or polypropylene with thin walls so as to be inexpensive and disposable. Cartridges also formed of paper, plastic, or impregnated paper may also be used. The rear end of the shell 84 is closed by a slideable cup like plunger 92 bearing against the contents within the cartridge, which is prefilled, preferably at the factory, with either the first or second component (resin or hardener). The outer surface of the cartridge 80, 82 adjacent its rear end is provided with an annular groove 94, which also can be made at the factory or later.

As seen in FIGS. 4 and 5, the four cartridges 80 and 82 are held together in the noted cluster 16 by providing at least one wafer-like holder 96 having conforming holes 98 for each of the cartridges as well as a central hole 100, sufficiently large to fit over the sleeve 28, FIG. 1. The holder 96 fits about the four cartridges 80 in the annular groove 94 to tie the cartridges together, to thereby prevent axial, rotary or other movement of the cartridges. The holder 96 may be made of plastic, rubber or other elastic material in the form of foil or film, having a small degree of stretch memory so as to be tightly stretched across the four cartridges to hold them secure, much in the manner of the ubiquitous beer and soda cans are held together for retail sale. The use of the elastic type holders 96, enables an array of four cartridges to be fixed securely in a square cluster package which can be handled and manipulated without disturbing the array, yet be sufficiently separable at their forward ends for easy entry into the cylinders of the barrel assembly.

In operation, the apparatus is employed by initially obtaining a cartridge cluster 16 loaded with the appropriate components. Assembly of the cartridges with adhesive components and assembly of the cluster can be made at the factory, or in situ from bulk sources or the like. It is, of course, preferred that the cluster assembly 16 be arranged earlier so that time lost at the work site be held to a minimum and that the proper component and their arrangement be assured before reaching the work site. The cluster 16 is easily handled since the wafer binder enables the cluster to be manipulated, without fear of loss of cartridges or confusing the various components.

Loading of the tool 10 with the cartridge cluster 16 is simple. The drive assembly 12 and barrel assembly 14 are separated and breeched. The cluster 16 with caps 90 removed from the cartridges 80, 82 may then be inserted so that a single cartridge fits in each of the cylinders 20 and can be pushed forwardly until the wafer holder 96 abuts against the rear of the cylinders 20. In this condition, the nipples 88 at the front of each of the cartridges enter into and are received in the appropriate one of holes 42, 44 in the manifold plate 34. The tool 10 is then closed and the barrel assembly 14 moved rearwardly until the drive rod engages into the sleeve 28.

To deliver the adhesive, the crank 74 is hand turned causing threaded drive rod 66 to rotate within the coupling 68 and engage the threads on sleeve 28. The female threaded sleeve 28, which is rigidly attached to the barrel assembly to be non-rotatable, receives the threaded drive rod 66 causing the rod to advance uniformly toward the manifold. The movement of the rod 66 carries the piston heads 78 into contact with plungers 92 within the cylinders 80, 82 causing the plungers to push the respective adhesive component out of each of the cartridges, into bores 42, 44 and thence into the outlet 46.

As the adhesive components pass through the nipples 88 the components, (i.e. resin and hardener) are directed through the manifold 34, and the material exits through the orifice 46 via the shut-off valve 54, into the mixing nozzle 36.

As will be observed, the two component cartridges are arrayed in the diagonal manner, so that during the dispensing process, i.e. extrusion, the forces transmitted by the reaction of the crank and nozzle assemblies, will be balanced uniformly about the axis of threaded drive rod 66 and about the periphery of the cluster. This diagonal and symmetrical positioning of the components and the need for the same, is a critical feature of this invention, since mixing of precise proportions of typically dissimilar adhesive components, without binding of the pistons in extrusion, is necessary to effect a good adhesive system. Further, undue stress and strain and interior pressure within the cartridge is so reduced, that rupture or collapse of the individual cartridges is prevented.

Although a two component adhesive system is shown, the same approach could be applied to a three or more component system, provided diagonal and circumferential balance is maintained in the number and arrangement of cartridges, since maintenance of homogeneous constant fluid pressure per individual component is assured.

FIGS. 6 through 10 show further embodiments, in which the entire apparatus is contained in a simply constructed and more unitary tool functioning in the manner of a front loading device. In this embodiment, the crank assembly 12 is unitarily formed with a four cylinder barrel assembly 14 by which the rear end of the cylinders are closed by the body 60, but the front ends are open at 100 for the receipt of the component cartridge assembly. As seen in the drawings, the same components bear reference numerals identical to those shown in FIGS. 1 through FIGS. 5. These components act in the same manner as previously described.

Since the barrel assembly 14 is fixed to the crank assembly 12, a hooked guide is not provided on the crank body 60. Slideable piston rods 102 fixed at their rear ends to a common block 104, pass freely through the body 60, extending parallel to the drive rod 66, which passes through a threaded stub sleeve 106 fixed against rotation and/or axial movement in the center of the body 60. The barrel assembly 14 extends forwardly from the fixed body 60 comprising four rigid cylinders joined axially to form a square cluster 110, thereby defining four hollow barrels open at their front ends into which a cartridge cluster such as FIG. 9 or preferred design, FIG. 12 can be inserted. Extending forwardly from the drive body 60 and laterally exterior of the cylinder cluster 110 are a pair of U-shaped lever arms 112. The arms 112 are pivotally mounted at their inner ends 114 to the body 60 by a toggle mechanism so as to be moveable toward each other, as shown by the arrows A whereby they can extend over the front or open ends 100 of the cylinder cluster 110, so that each arm 112 blocks a respective pair of cylinders 110. Thus, when the cartridge cluster is inserted into the barrel, the U-shaped lever arms 112 are toggled to hold the cartridges securely against the pressure of extrusion. When empty, the cartridge can be easily removed after opening the levers arms 112. The toggles are formed so as to lock in place in the closed position.

It will also be understood at this stage, that the cartridge cluster used in this embodiment may be formed as previously shown in FIGS. 3–5 although without the notches and the wafer holder.

Figure 12:
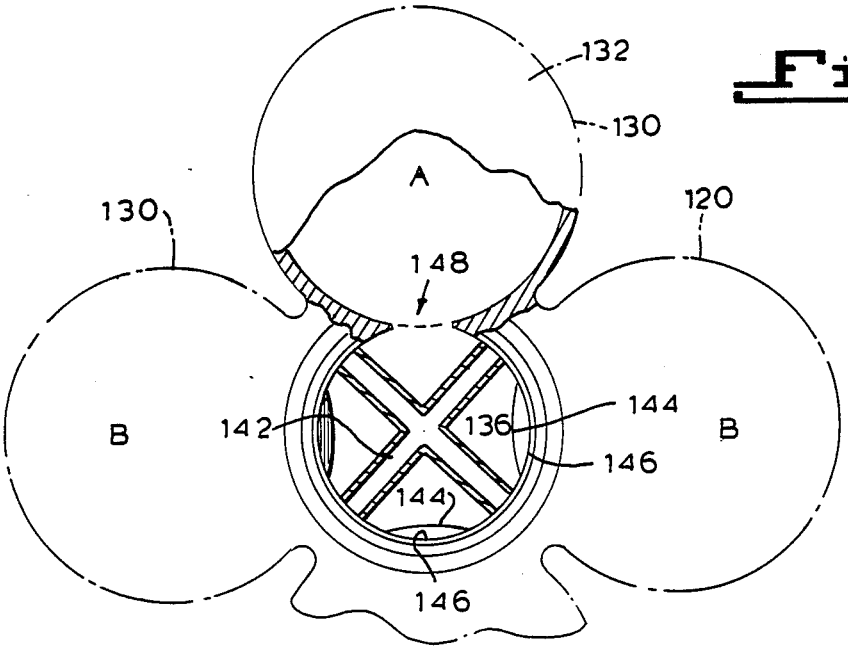
FIG. 12 is a partially sectioned enlarged end view taken in the direction of line XII—XII of FIG. 11.

In FIGS. 7 through 10, a cartridge cluster is shown which is particularly adapted to the front loading barrel type tool of FIG. 6. As seen in detail in FIG. 7, each of the cartridges 116, having a plunger 117 while basically the same in construction as those shown earlier, is formed with an orifice nipple 118 which is not centrally located at the front end of the cartridge, but is offset to the peripheral edge, to form a circular sector or pie-shape fitting. The nipple 118 extends to the side and somewhat parallel to the axis of the cartridge, providing a radial passageway 120 from the interior of the cartridge outwardly and is provided with an radially flare tip 121. The arcuate peripheral surface from which each nipple 118 extends with an exterior thread portion 122. The nipples 118 are embedded in the overall shape of a quarter sector (FIG. 9) so that when four cartridges are brought together, the adjacent quarter sections complete a circular fitting, concentric about the central axis (FIG. 9), and the arcuate peripheral surface, provided with a thread portion 122, form a complete threaded surface, onto which a mixing nozzle retaining cap such as 56, FIG. 1*a* or the preferred design 150, FIG. 12 is screwed prior to dispensing of adhesive components. A cap 126 (FIG. 8) may be applied thereon to permit transport and storage.

Cartridges 116 are joined via elastic wafer fitting 128 which has four openings 129 designed to receive the slightly flared tips 121 of nipples 118. Joining wafer 128 serve to form a permanent cluster of diagonally placed components.

It will be observed that in the cluster shown in FIGS. 7–10, the cartridges 116 are held by their front ends, rather than by their rear ends, thus allowing the cartridge cluster FIG. 9 to be easily front-loaded into the cylinder cluster 110 from the front. The cartridges are significantly moveable with respect to each other so that they can be fitted easily into the respective cylinders.

Further, in this embodiment as in the others, it will also be noted that the arrangement of the cartridges holding the two component adhesive system is such that the components are diagonally positioned and alternate with respect to each other about the central axis and the periphery that all of the cartridges are loaded in an alternating pattern coaxial about the center of the cluster. During the dispensing process, forces transmitted to the plungers, balance uniformly round the threaded drive rod.

Yet another form of cartridge cluster suitable for the front loading tool of FIG. 6 is shown in FIGS. 11 and 12. In this embodiment, an internally formed cluster of four cartridges 130 closed at their front end by a fixed wall 132 and at its rear end by a slideable plunger 134. The four cartridges 130 are joined in a quadrilateral by a rigid fixed web shaped collar 136 set below the front wall 132, which integrally joins the cartridges together.

A cylindrical head 138, having exterior threads 140, or twist bayonet-type lock is attached across each of the cartridges concentric to the collar 136. The head 138 acts to strengthen and hold the cartridges 130 and in their relative fixed positions as shown by being preferably integrally molded therewith together with the collar 136. To provide added strength, a cruxiform web 142 is inserted into the head 138 at the bottom against the collar 136. The web 142 may be separate and attached to both the head and collar by adhesives or may be integrally molded therewith. An arcuate sector 144 of each cartridge, overlaps the opening of the head 138 and sector 146 of the wall forming the cylinder 130 between the collar 136 and the front wall 132, where it intersects with the sector 144 and is formed of material which provides a rupturable seal which when broken, established four passageways 148 providing communication between the interior of the respective cartridges 130 and the head 138, thus providing a tortuous passage from each cartridge through the passageways 148 and head 138 as indicated by the arrows B. The frangible wall section 146 is preferably formed by thin plastic, in situ when the cluster is molded and is of sufficient strength to maintain the integrity of the cartridge during storage and shipping, but rupturable automatically upon the application of pressure to extrude the adhesive component from the cartridge. The rupturable seal formed in section 146, although shown formed on the side wall of the cartridge can be formed at their front end 132 with the head sufficiently large to cover the passageway formed by it. On the other hand, the section 146 can be left without any covering or seal material, and a removeable plug or seal placed into the head 138 or over its open end so as to be removed or cut-off.

The outer threaded peripheral surface 140 of the head 138 is adapted to receive a shut off valve and/or an mixing nozzle in the manner as previously described. This cluster, preferably unitarily molded is a somewhat stronger cluster than that shown in FIGS. 7–10 although it may be just as easily used in the front loading tool shown in FIG. 6.

As will be seen in this last embodiment, as in all of the other embodiments, the two part adhesive system is arranged in both a diagonal and circumferential manner about the central axis so that equalization of the forces applied, takes place. The illustrated embodiment shown in FIGS. 12 and 13, permits easy assembly and loading of the cluster in the tool of FIG. 6 eliminating the wafer holder and providing a more durable unit both for storage and transport, as well as during actual use. The assembly of this unit does not require caps and is less likely to leak during storage as well as during operation.

Figure 13:
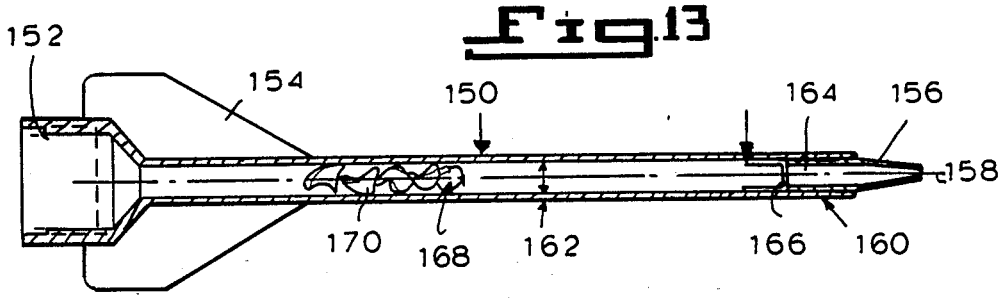
FIG. 13 is a sectioned view of the mixing nozzle employed in the present application.

In FIG. 13, there is illustrated a preferred form of mixing nozzle 36 suitable for use with any of the cartridge clusters and tools as shown herein. The use of nozzle 36 required retaining cap 56, whereas mixing nozzle 150 has an integrated retaining thread or twist lock 152. The front end 156 of the tube is tapered to form a restricted opening 158. Set back from the tapered front end 156, is a threaded section 160 on which nozzle extrusion of the same type as herein shown can be attached, thereby lengthening the reach of the tube 150. The inner diameter of the tube 150 is stepped, having a long length 162 of a first diameter, and a shorter length 164 at the front tip of a smaller diameter. The two sections are separated by a shoulder 166. Located within the longer or larger diameter section is a static mixing element 168 formed of a series (only a few are shown) of helically bent blades 170 arranged to provide intimate mixing of the resin components and insure that a homogeneous mass is expelled from the tip 158.

It will be seen from the foregoing that the present invention provides a unique portable tool enabling the ejection of the multi-component adhesive to be dispensed and delivered at the exact site wherein the material is actually needed, i.e the voids, spaces, holes or the like, in masonry or between masonry units. The present apparatus incorporates a unique four barrel feature that broadens the thixoprophy tolerances of the adhesive system by enabling a wide variation of the mixing of the components while insuring that such mixing will be uniform and homogeneous, largely due to the maintenance of uniform and steady pressure application on each cartridge.

A significant advantage of the present invention arises from the ability of the tool to balance the forces of extrusion about the drive axis so that canting or production torque is virtually eliminated. As a result of the lower stress on the material of the tool, a lighter and less expensive tool can be made.

The present apparatus also enables the use of a single separate and disposeable shut off valve, which may be provided for the plural cartridge pack and which is easily disposeable and dispensible. This reduces the cost of the present systems wherein a valve is required for each individual cartridge.

While a manually operable crank is disclosed for causing the extrusion of the material, the device is easily adaptable to the impact drive mechanism disclosed in the inventor's earlier patent application Ser. No. 121,287. Impact drive tools are readily available and may be pneumatic, electric or cordless.

The components of the apparatus heretofore described, i.e the cartridges and the crank mechanism, as well as the valve extrusion assembly may be manufactured using a variety of materials such as aluminum, plastic, steel, etc., or any combination of these materials. While the cylindrical cartridges are shown as circular in cross section, they may be of any shape, provided they can be joined together by a holder or other means to form a four cartridge or multiple cartridge symmetrical configuration having a quadrulateral cross section as described. The cartridges themselves, can be molded together into a unitary pack eliminating the need for separate wafers.

The cartridges, although preferably loaded and filled with the epoxy components at the factory site may be delivered empty and clean and filled with the respective components at the work station.

The mixing ratios of the two component systems can be varied to accommodate other two component formulations by altering proportionately the diameters of the diagonal cavities. The mix ratio achieved will be equal to the ratio of the diagonal cross-sectional areas of the individual component cavities.

Various modifications, changes and embodiments have been described herein. Others will be obvious to those skilled in the present art. Accordingly it is intended that the present disclosure be taken as illustrative only of the invention and not as limiting thereof.

What is claimed is:

1. A method for delivering a multicomponent adhesive system to a work site, comprising the steps of providing each component of said adhesive system in a separate cartridge having an orifice at one end and a slideable plunger at the other, arranging the respective component cartridges of said adhesive system in an array parallel to and centric about a common axis, symmetrically to each other, applying a simultaneously uniform force against each of the slideable plungers to push the components from each said cartridge through its respective orifice, in intimate engagement with each other to mix said components uniformly directly as they are pushed from said cartridges, and thereafter extruding said mixed components directly to said work site.

2. The method according to claim 1 wherein said adhesive system consists of an even number of components and the cartridges are uniformly arrayed about said common axis in alternate opposition to each other, wherein the individual components of each system are extruded evenly.

3. Apparatus for delivering a multicomponent adhesive system to a work site, said adhesive system comprising a plurality of cartridges each containing an individual component and having an orifice at one end and a slideable plunger at the other end, said apparatus comprising means for removably arranging said cartridges parallel to and centric about a common axis with the individual component cartridges arrayed symmetrically to each other, a mixing chamber mounted at the forward end of said array in communication with each of said orifices having an extrusion nozzle extending outwardly from said mixing chamber, and means operable to apply a force on said plungers to simultaneously push said components from said cartridges through said orifices into said mixing chamber wherein said components are mixed and from which extruded through said extrusion nozzle.

4. The apparatus according to claim 3 wherein said component consists of resin and hardener respectively.

5. The apparatus according to claim 4 including means for holding said array of cartridges in fixed arrangement.

6. The apparatus according to claim 3 wherein said means for applying a force on the plungers of said cartridges comprises an array of pistons, securable adjacent the ends of said arrayed cartridges, each being simultaneously activated to push said pistons into engagement with said plungers with equal force.

7. The apparatus according to claim 6 wherein said pistons are driven by a threaded rod, passing through a thread sleeve arranged along the center of said array, and a manually operable crank handle attached thereto.

8. The apparatus according to claim 7, wherein said means of holding said cartridges in fixed position comprises a hollow barrel formed by joining hollow cylinders, closed at one end, receiving a cartridge cluster therein.

9. The apparatus according to claim 8 wherein said hollow barrel is shaped to accommodate the arrayed cartridges.

10. The apparatus according to claim 3 wherein said mixing chamber comprises a manifold body, having a plurality of inlet ports conforming to the position of each of the cartridge orifices, and respective bores communicating said ports in common with a single outlet port said ports and bores being sized to effect uniform mixing of said components prior to arrival at said outlet orifice.

11. The apparatus according to claim 10 wherein said extrusion nozzle is an elongated nozzle attachable to said outlet port for carrying said mixed component to said work site.

12. Apparatus for delivering a multicomponent adhesive system to a work site, said adhesive system comprising a plurality of elongated cylindrical cartridges each containing an individual component each of said cartridges having an orifice at one end and a slidable plunger at the other end, means for arranging said cartridges parallel to and centric about a common axis with the individual component cartridges arrayed symmetrically to each other, a mixing chamber mounted at the forward end of said array in communication with each of said orifices having an extrusion nozzle extending outwardly from said mixing chamber, said means operable to apply a force on said plungers to simultaneously push said components from said cartridges through said orifices into said mixing chamber wherein said components are mixed and extruded through said extrusion nozzle, where said cartridges are elongated cylinders said orifices are arranged at the perimeter thereof, said orifices being formed as a nipple having a pie-shaped cross-section so that when the cartridges are arrayed, the nipples are adjacent to each other and form a cylindrical multi-orifice fitting.

13. The apparatus according to claim 12 wherein the exterior surface of said nipples is provided with a threaded sector, said sectors cooperating to form a threaded cylindrical surface for receiving said nozzle.

14. A method for delivering a two component adhesive system to a work site, comprising the steps of providing each component in a separate cartridge having an orifice at one end and a slidable plunger at the other, arranging said cartridges in alternate pairs parallel to and concentric about a common axis, so that the respective components in each system are arranged in diagonal opposition to each other, applying a force simultaneously against each of the slidable plungers to push the components from each said cartridge simultaneously through an outlet nozzle, to uniformly mix the components directly as they are pushed from the cartridge and thereafter extrude said mixed component directly to said work site.

15. The method according to claim 14, including the step of balancing the application of force against said plungers to provide uniform force application thereto.

16. Apparatus for delivering a two component adhesive system to a work site, said adhesive system comprising a plurality of cartridges each containing an individual component and having an orifice at one end and a slidable plunger at the other end, said apparatus comprising means for arranging said cartridges diagonally paired, parallel to and concentric about a common axis with the individual component cartridges arrayed symmetrically to each other, a mixing chamber mounted at the forward end of said array in communication with each of said orifices having an extrusion nozzle extending outwardly from said mixing chamber, and means operable to apply a force on said plungers to simultaneously push said components from said cartridges through said orifices into said mixing chamber wherein said components are mixed and extruded through said extrusion nozzle.

17. The apparatus, according to claims 16, wherein said array comprises a plurality of paired component cartridges, said pairs being arranged alternately within said array.

* * * * *